US005901908A

United States Patent [19]

Goenka et al.

[11] Patent Number: 5,901,908

[45] Date of Patent: May 11, 1999

[54] SPRAY NOZZLE FOR FLUID DEPOSITION

[75] Inventors: Lakhi Nandlal Goenka, Ann Arbor; Jay DeAvis Baker, Dearborn, both of Mich.

[73] Assignee: Ford Motor Company, Dearborn, Mich.

[21] Appl. No.: 08/757,360

[22] Filed: Nov. 27, 1996

[51] Int. Cl.[6] ..... B05B 7/04

[52] U.S. Cl. ..... 239/432; 239/433; 239/543; 261/78.2

[58] Field of Search ..... 239/432, 433, 239/543; 261/116, 118, 78.2

[56] References Cited

U.S. PATENT DOCUMENTS

| | | | |
|---|---|---|---|
| 2,233,304 | 2/1941 | Bleakley | 91/12.2 |
| 2,800,419 | 7/1957 | Kough . | |
| 4,044,081 | 8/1977 | Weidlich | 239/423 X |
| 4,171,777 | 10/1979 | Behr | 239/422 |
| 4,291,316 | 9/1981 | Kakeno et al. | 346/140 R |
| 4,349,156 | 9/1982 | Haruch et al. | 239/432 |
| 4,416,421 | 11/1983 | Browning | 239/79 |
| 4,527,507 | 7/1985 | Sawai et al. | 118/314 |
| 4,564,846 | 1/1986 | Siegal | 346/75 |
| 4,619,845 | 10/1986 | Ayers et al. | 427/422 |
| 5,030,971 | 7/1991 | Drake et al. | 346/140 R |
| 5,080,285 | 1/1992 | Toth | 239/300 |
| 5,203,843 | 4/1993 | Hoy et al. | 239/135 |
| 5,302,414 | 4/1994 | Alkhimov et al. | 427/192 |
| 5,390,450 | 2/1995 | Goenka | 451/75 |
| 5,419,348 | 5/1995 | Kuta | 134/58 R |
| 5,514,024 | 5/1996 | Goenka | 451/39 |
| 5,516,043 | 5/1996 | Manna et al. | 239/102.2 |
| 5,524,660 | 6/1996 | Dugan | 137/14 |
| 5,545,073 | 8/1996 | Kneisel et al. | 451/39 |
| 5,549,246 | 8/1996 | Kukesh | 239/9 |

OTHER PUBLICATIONS

"Sonimist Ultramsonic Spray Nozzles", Technical Buletin of Heat Systems–Ultrsonics, Inc., 1938 New Highway, Farmingdate, N.Y. 11735, 5 pgs.

*Primary Examiner*—Lesley D. Morris
*Attorney, Agent, or Firm*—Leslie C. Hodges; Roger L. May

[57] ABSTRACT

A fluid spray nozzle that mixes a pressurized gaseous propellant and paint composition prior to being applied to a workpiece. The nozzle includes an upstream section for receiving the pressurized gaseous propellant. The nozzle directs the gaseous propellant and the fluid composition into a recirculation cavity. The gaseous propellant and fluid composition are received in a downstream section after mixing in the recirculation cavity. The recirculation cavity has lobes on opposite sides of a flow path defined in a region in the recirculation cavity between an inlet opening and the recirculation cavity. The recirculation cavity is formed by silicon micromachining the upstream section, fluid injection section, recirculation cavity and downstream section. The gaseous propellant may be accelerated to supersonic speeds prior to entering the recirculation cavity. The gaseous propellant and fluid composition are decelerated to subsonic speeds prior to exiting the downstream section, thereby resulting in the formation of a shock wave at the transition from supersonic to subsonic speeds which causes further atomization of the fluid composition.

7 Claims, 3 Drawing Sheets

SPRAY NOZZLE FOR FLUID DEPOSITION

TECHNICAL FIELD

The present invention relates to atomizing spray nozzles.

BACKGROUND OF THE INVENTION

Atomizing spray nozzles are generally complex assemblies requiring many tubular parts that are expensive to manufacture. Atomizing spray nozzle are not amenable to generalized applications and must be customer designed depending on the product to be sprayed. Conventional patent spray systems suffer from disadvantages associated with overspray, paint deposition control, adequate atomization and minimizing volatile organic compounds (VOCs) in the paint which are used to aid in dissolving and transporting paint. Spray nozzles are generally individually assembled and are formed of many critical components.

Prior art paint spray nozzles generally are not easily ganged on a head to provide a paint spray head which is capable of applying a plurality of different colored pigments.

SUMMARY OF THE INVENTION

According to the invention, an apparatus for painting a workpiece is provided comprising a nozzle for mixing pressurized gaseous propellant and a paint composition. The nozzle includes an upstream section for receiving the pressurized gaseous propellant, a paint injection section for receiving the paint composition, a recirculation cavity into which pressurized gaseous propellant and the paint composition are received, and a downstream section through which gaseous propellant and paint composition are directed. The recirculation cavity has first and second lobes on opposite sides of a flow path defined by a region in the recirculation cavity between an inlet opening in the recirculation cavity where the upstream section opens into the recirculation cavity and an outlet opening in the recirculation cavity where the downstream section opens into the recirculation cavity.

According to one aspect of the invention, the upstream section, paint injection section, recirculation cavity and downstream section are all formed by silicon micromachining in a unitary plate to which one or two other plates are secured to form the enclosed cavity defining the nozzle. As disclosed, the nozzle may be formed from either two or three plates. The nozzles may also be conventionally machined from stainless steel, plastic, or any other suitable material.

The paint injection section enters the recirculation cavity in one of the lobes. The paint composition is turbulently mixed by the action of the pressurized gaseous propellant flowing at supersonic or high subsonic speeds within the recirculation cavity. The upstream section of the nozzle is contoured with a restriction which accelerates the gaseous propellant and causes the atomized paint composition and propellant to flow at supersonic speed into the downstream section. The downstream section is contoured to decelerate the gaseous propellant and atomized paint composition to subsonic speeds prior to exiting the downstream section. A shock wave is formed at the transition from supersonic to subsonic speed which causes further atomization of the paint composition and reduces the speed of the paint composition prior to deposition on a work surface.

According to the invention, a simple nozzle structure is disclosed which may be formed from a silicon micromachined plate which is secured to one or two plates to form a nozzle cavity. Nozzles made according to the invention are adaptable to many atomizing applications including painting, applying flux or conformal coatings and water misting.

Advantages achievable with the invention include minimizing overspray and emission of VOCs while increasing atomization and paint deposition control.

These and other advantages of the present invention will be better appreciated in view of the attached drawings and the following detailed description of preferred embodiments of the invention.

DETAILED DESCRIPTION OF THE PREFERRED EMBODIMENT

Figure 1:
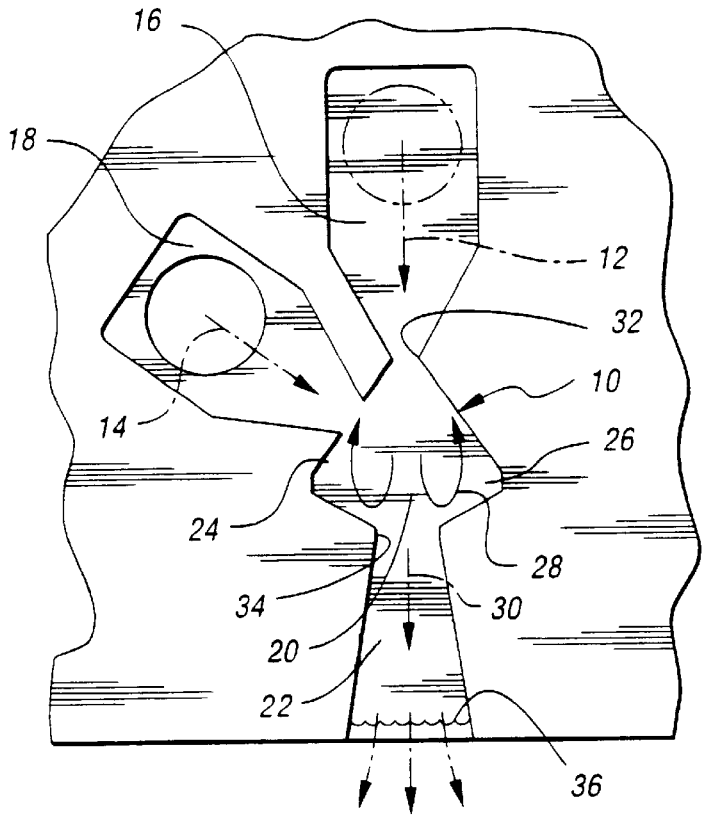
FIG. 1 is a diagrammatic fragmentary plan view of a nozzle made in accordance with the present invention.

Referring now to FIG. 1, a nozzle 10 is shown with flow diagrammatically depicted. A gaseous propellant is shown by flow arrow 12 and a paint composition flow is shown by flow arrow 14. Other compositions such as flux, conformal coating or water could be used instead of paint. It would also be possible to reverse the nozzle feeds and have the gaseous propellent flow as shown by flow arrow 14.

The gaseous propellant 12 is supplied in upstream section 16 of the nozzle while the paint composition 14 is supplied to paint injection section 18. The gaseous propellant 12 and paint composition 14 are supplied to a recirculation section 20 where they are turbulently mixed prior to entering a downstream section 22. The recirculation section 20 has first and second lobes 24 and 26 in which the paint composition 14 is mixed with the gaseous propellant 12 in a recirculatory path shown by flow arrows 28. The flow path of the combined gaseous propellant and paint composition in the downstream section 22 is shown by flow arrow 30. The flow path 30 extends from the inlet opening 32 of the recirculation section 20 to an outlet opening 34 into the downstream section 22. The downstream section 22 is contoured to allow the flow path 30 to decelerate as it proceeds through the downstream section 22.

The upstream section 16 is preferably contoured to allow the gaseous propellant 12 to flow at supersonic speeds as it passes through the inlet opening 32. The gaseous propellant 12 and paint composition 14 are mixed at supersonic speeds and supplied to the downstream section 22 at supersonic speeds. Due to the divergent contour of the downstream section 22, the flow path 32 transitions to subsonic speeds within the downstream section 22 and preferably creates a shock wave 36 at the transition point. As the gaseous propellant 12 and paint composition 14 move through the shock wave 36, further atomization of the paint composition 14 occurs and the flow indicated by flow path arrow 30 is further decelerated. By further atomizing the paint composition and decelerating the paint composition prior to deposition on a work surface, the paint composition is more thoroughly atomized and slowed, reducing bounce from the work surface to which the paint composition and gaseous propellant are directed.

The gaseous propellant is preferably supplied at a pressure of 30 to 150 psig. The paint, or liquid, composition is preferably supplied at 30 to 90 psig. The pressure in the lobes is 25 to 75 psig.

It should be noted that while the present invention is described in conjunction with painting, the nozzle of the present invention is applicable to any atomizing application including application of flux or conformal coatings in printed circuit board manufacture. The nozzle could also be used in water misting applications. Instead of supplying paint to the paint injection section, flux, conformal coating, or water could be supplied as will be readily appreciated by one of ordinary skill in the art.

Figure 2:
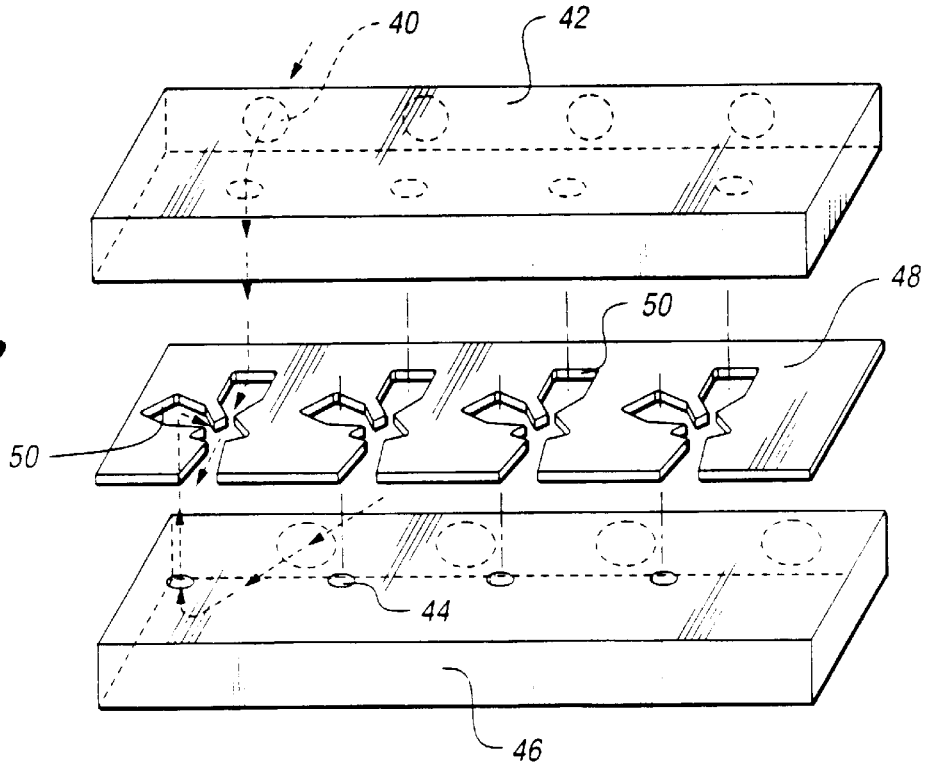
FIG. 2 is an exploded perspective view of a group of four nozzles formed in accordance with the present invention.

Referring now to FIG. 2, one embodiment of the present invention is shown wherein propellent ports 40 are provided in a propellant supply plate 42. Paint ports 44 are provided in a paint supply plate 46. The propellant supply plate 42 and paint supply plate 46 sandwich a nozzle plate 48 which includes a plurality of nozzles 50 formed in accordance with the nozzle structure described in conjunction with FIG. 1.

Figure 3:
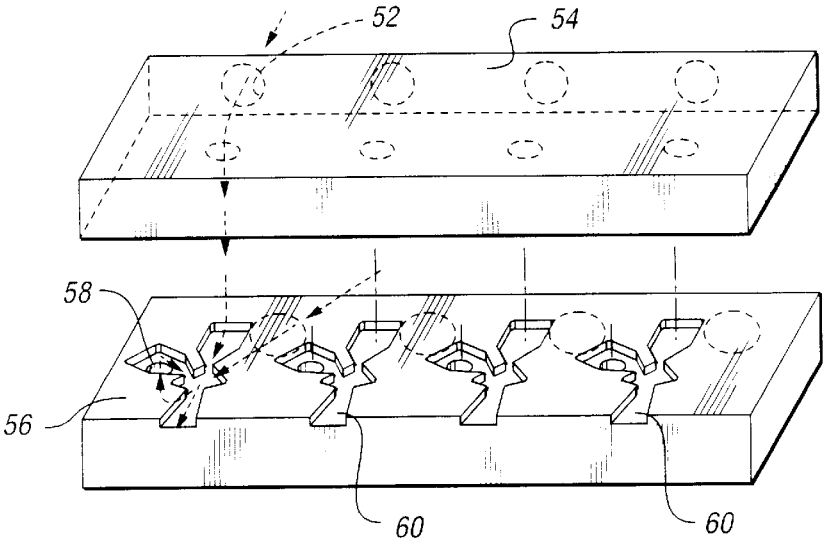
FIG. 3 is an exploded perspective view of an alternative embodiment of the present invention showing a group of four nozzles formed in accordance with the invention.

Referring now to FIG. 3, an alternative embodiment of the present invention is shown wherein propellant ports 52 are provided in a propellant supply plate 54. A combined paint supply and nozzle plate 56 is provided which includes paint ports 58 and nozzles 60 which are micromachined in one surface of the paint supply and nozzle plate 56. According to this embodiment, a plurality of nozzles can be formed by providing two plates 54, 56 with one plate being micromachined to form the nozzle and the other plate being provided to form the enclosure defining the nozzle 60.

Figure 4A:
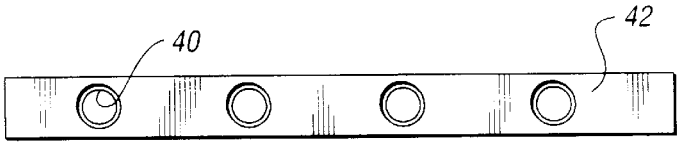
FIG. 4*a* is rear elevation view of a plate showing ports for receiving the pressurized gaseous propellant.
Figure 4B:
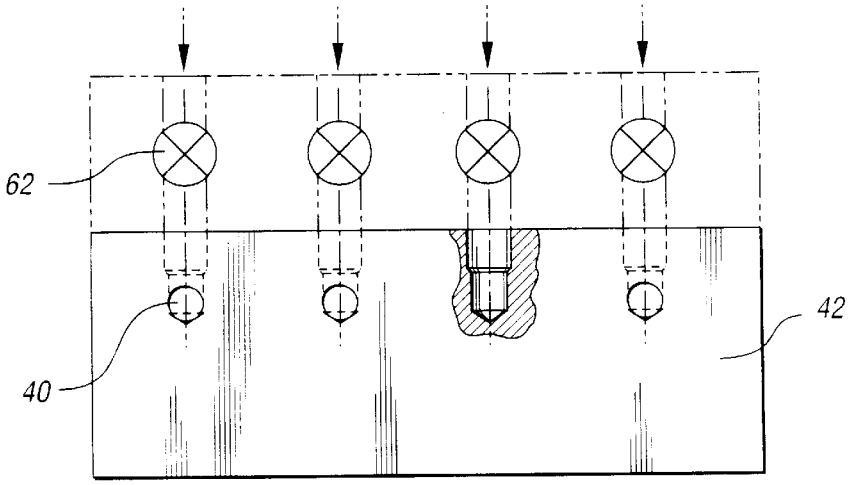
FIG. 4*b* is a top plan view partially fragmented to show ports in the plate through which the pressurized gaseous propellant is supplied to the nozzle.

Referring now to FIGS. 4*a* and *b*, the propellant supply plate 42 is shown with the propellant ports 40 shown. Propellant valves 62 are shown diagrammatically in a valve section which is shown in phantom. The valve section may be secured to the rear of the propellant supply plate 42 in a simple and effective valving arrangement. It should be understood that while the propellant supply plate has been described in conjunction with reference numerals of FIG. 2 the same description is applicable to the propellant supply plate 54 of FIG. 3.

Figure 5A:
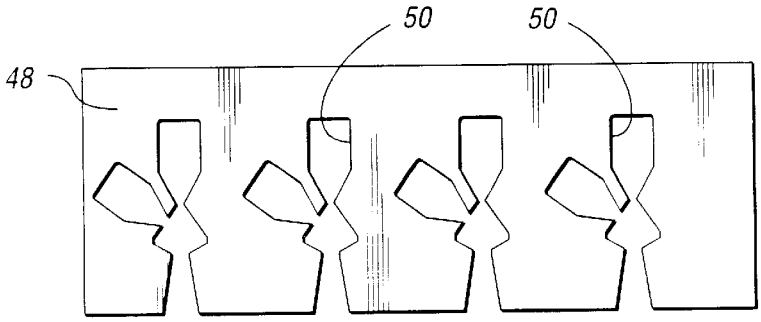
FIG. 5*a* is a top plan view of a plate shown in FIG. 2 which is silicon micromachined to form the nozzles.
Figure 5B:
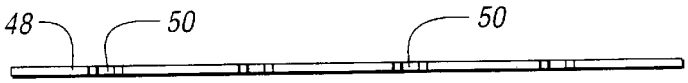
FIG. 5*b* is a front elevation view of the plate having silicon micromachined nozzles formed therein.

Referring now to FIGS. 5*a* and *b*, the nozzle plate 48 of the embodiment of FIG. 2 is shown to include a thin plate micromachined to form a plurality of nozzles 50. In this embodiment, the nozzles 50 are cut entirely through the nozzle plate 48 and the nozzles 50 are completed by sandwiching the nozzle plate 48 between the propellant supply plate 42 and the paint supply plate 46.

Figure 6A:
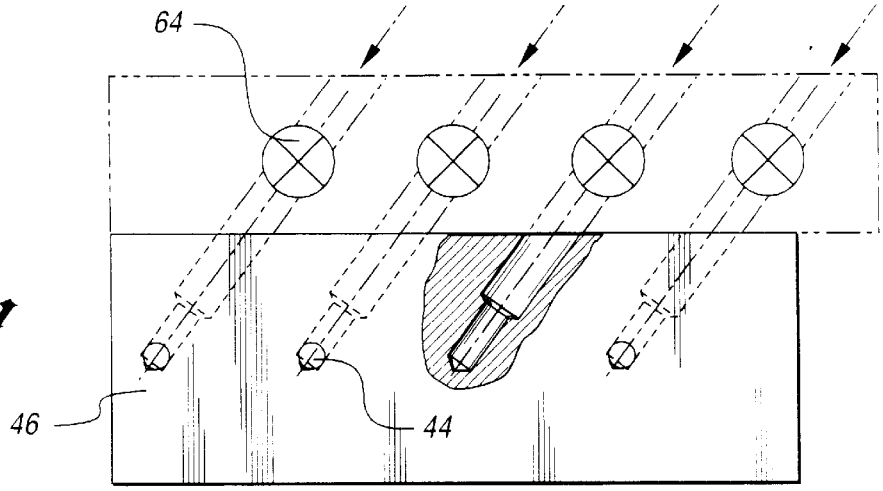
FIG. 6*a* is a partially fragmented view of the plate shown in FIG. 2 including the paint composition ports.
Figure 6B:
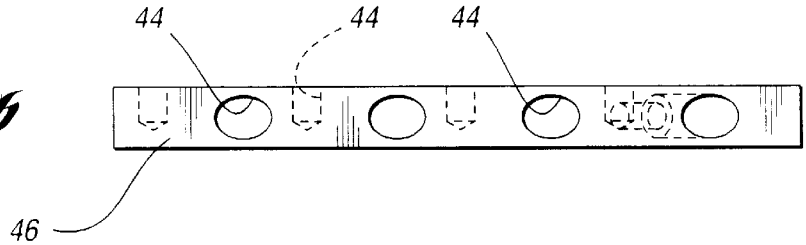
FIG. 6*b* is a rear elevation view of the plate shown in FIG. 2 including the paint composition ports.

Referring now to FIGS. 6*a* and *b*, the paint supply plate 46 of the embodiment of FIG. 2 is shown to include paint ports 44 which extend in an angular relationship to the paint supply plate 46 opening from the rear of the paint supply plate 46 and the nozzle 50. A valve section shown in phantom includes paint valves 64 which control the flow of paint.

Figure 7A:
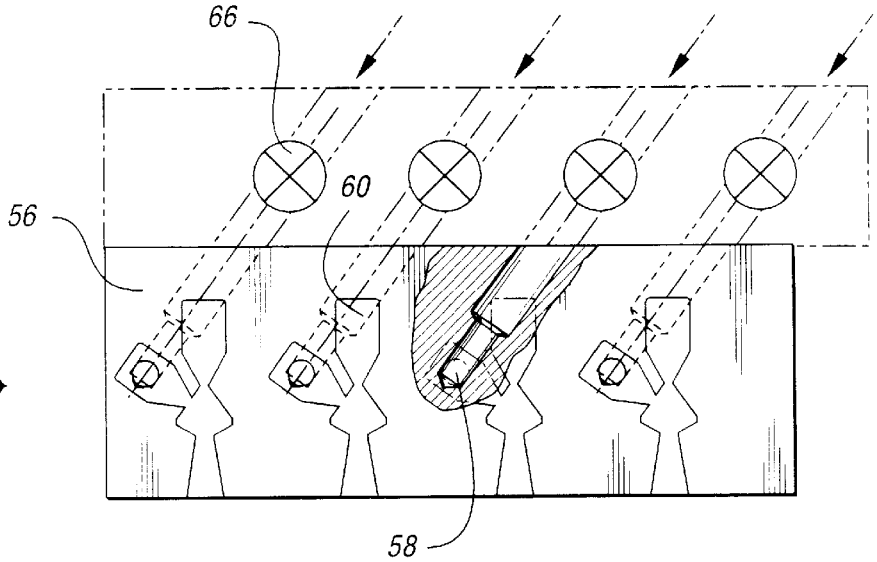
FIG. 7*a* is a fragmentary cross-sectional view corresponding to FIG. 3 of the plate in which the nozzles are silicon micromachined and also including the paint composition ports.
Figure 7B:
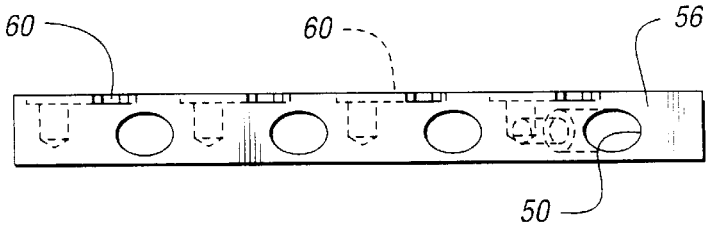
FIG. 7*b* is a rear elevation view of the plate including the paint composition ports and nozzles.

Referring now to FIGS. 7*a* and *b*, the combined paint supply and nozzle plate 56 of the embodiment of FIG. 3 is shown to include paint ports 58 and nozzles 60 which are silicon micromachined into the combined paint supply and nozzle plate 56. Paint valves 66 are provided in a valve section shown in phantom.

The present invention has been described in conjunction with two preferred embodiments. It will be readily understood by one of ordinary skill in the art that the invention can be modified. The above descriptions of the preferred embodiments should be read in an illustrative sense and not to limit the scope of the invention which should be construed in accordance with the following broad claims.

What is claimed is:

1. An apparatus comprising a nozzle for mixing and applying a pressurized gaseous propellant and a liquid composition including:

an upstream section for receiving the pressurized gaseous propellant;

a liquid injection section for receiving the liquid composition;

a recirculation cavity into which the pressurized gaseous propellant and the liquid composition are received;

a downstream section coupled to the recirculation cavity for receiving the gaseous propellant and the liquid composition; and wherein said recirculation cavity has first and second lobes on opposite sides of a flow path defined by a region in the recirculation cavity between an inlet opening in the recirculation cavity where the upstream section opens into the recirculation cavity and an outlet opening in the recirculation cavity where the downstream section opens into the recirculation cavity.

2. The apparatus as described in claim 1 wherein said recirculation cavity is formed by silicon micromachining said upstream section, fluid injection section, recirculation cavity and downstream section in one plate member to which another plate is secured to form the cavities.

3. The apparatus as described in claim 1 wherein said inlet opening and said outlet opening are disposed at diametrically opposed points on said recirculation cavity.

4. The apparatus as described in claim 1 wherein said fluid injection section enters said recirculation cavity in one of said lobes, said fluid composition being turbulently mixed by the action of the pressurized gaseous propellant within the recirculation cavity.

5. The apparatus as described in claim 1 wherein said upstream section is contoured to accelerate the gaseous propellant and the fluid composition to supersonic speeds in said downstream section.

6. The apparatus as described in claim 5 wherein said downstream section is contoured to decelerate the gaseous propellant and the fluid composition to subsonic speeds prior to exiting said downstream section thereby resulting in the formation of a shock wave at the transition from supersonic to subsonic speed which causes further atomization of the paint composition and reduces the speed of the fluid composition prior to deposition on a work surface.

7. The apparatus as described in claim 1 wherein said gaseous propellant is supplied at a pressure of 30 to 150 psig, said fluid composition is supplied at a pressure of 30 to 950 psi, and the pressure is said lobes is 25 to 75 psi.

* * * * *